US010098488B2

(12) United States Patent
Boyatt

(10) Patent No.: US 10,098,488 B2
(45) Date of Patent: Oct. 16, 2018

(54) CARRY TRAY

(71) Applicant: Natalie Jean Boyatt, Germantown, TN (US)

(72) Inventor: Natalie Jean Boyatt, Germantown, TN (US)

( * ) Notice: Subject to any disclaimer, the term of this patent is extended or adjusted under 35 U.S.C. 154(b) by 334 days.

(21) Appl. No.: 14/992,780

(22) Filed: Jan. 11, 2016

(65) Prior Publication Data

US 2016/0120349 A1 May 5, 2016

Related U.S. Application Data

(60) Provisional application No. 62/233,456, filed on Sep. 28, 2015.

(51) Int. Cl.
*B65D 71/70* (2006.01)
*A47G 23/06* (2006.01)

(52) U.S. Cl.
CPC ..... *A47G 23/0641* (2013.01); *A47G 23/0616* (2013.01)

(58) Field of Classification Search
CPC ..... B65D 71/70; B65D 1/36; B65D 1/243
USPC ..... 206/199, 562, 563, 564
See application file for complete search history.

(56) References Cited

U.S. PATENT DOCUMENTS 2,459,921 A * 1/1949 Comer ..... B65D 71/0003 126/9 A
4,792,184 A * 12/1988 Lindberg ..... A47C 7/62 297/150
6,527,123 B1 * 3/2003 Ausaf ..... A47J 47/14 206/541
2012/0228188 A1 * 9/2012 Hatcher ..... A47G 23/06 206/565

* cited by examiner

*Primary Examiner* — King M Chu
(74) *Attorney, Agent, or Firm* — Wayne Edward Ramage; Baker Donelson

(57) ABSTRACT

A carry tray a two-part base hingedly attached in the middle along adjacent edges. A removable or detachable handle may be provided. Each base comprises a bottom with a side extending upwards along the circumference, in whole or in part Each part of the base can be polygonal, semi-circular, hemi-circular, rectilinear, curved, or combinations thereof. The tray can be folded up along the hinge into a closed position for convenient storage or transport when not in use. The base contains an arrangement of fins to help hold cups or containers, and may be used with a removable template or foam insert.

14 Claims, 16 Drawing Sheets

CARRY TRAY

This application claims benefit of and priority to U.S. Provisional Application No. 62/233,456, filed Sep. 28, 2015, by Natalie Jean Boyatt, and is entitled to that filing date for priority. The specification, figures, and complete disclosure of U.S. Provisional Application No. 62/233,456 are incorporated herein in their entireties by specific reference for all purposes.

FIELD OF INVENTION

This invention relates to a folding, convertible tray for carrying multiple drinks or beverages or other items.

SUMMARY OF INVENTION

In various embodiments, the present invention comprises a carry tray with a removable or detachable handle. The tray comprises a two-part base hingedly attached in the middle along adjacent edges. Each base comprises a bottom with a side extending upwards along the circumference, in whole or in part Each part of the base can be polygonal, semi-circular, hemi-circular, rectilinear, curved, or combinations thereof. The parts of the base can be mirror images of each other, although in other embodiments the two parts may vary. The tray can be folded up along the hinge into a closed position for convenient storage or transport when not in use.

In one exemplary embodiment, one or both of the base parts comprise a plurality of alignment fins or tabs. The alignment fins are arranged or positioned to engage the bottom of a cup or bottle and help secure or hold the cup or bottle in place. The fins may be tapered or rounded, to help receive and guide the bottom of the cup or bottle into place. Any number of fins can be used to engage each cup or bottle. In some embodiments, no alignment fins or tabs need be used, or alternative means to help secure the bottom of each cup or bottle may be used (such as indentations or recessed areas in the base).

One more hole templates also may be used to help secure cups or bottles. Templates may be sized to match the corresponding base part, and may be removably secured thereto (i.e., snap-fit into the base part). Templates comprise one or more holes into which a cup or bottle is inserted. Holes are positioned to align with corresponding sets of alignment fins or tabs. In one embodiment, flexible tabs may extend at an angle inside each hole to engage the sides of the cup or bottle and help hold it upright therein.

The carry tray can thus be used to carry drinks on both sides. Alternatively, a hole template can be removed from one side, thereby allowing the carry tray to be used to carry drinks on one side, and other items (e.g., food, snacks, and the like) on the other side. Both hole templates also may be removed and carry tray used for food, snacks, and the like on both sides.

In another exemplary embodiment, foam inserts may be used in place of hole templates (or as a form of hole template). The foam inserts may be placed into corresponding base parts, and are held in place due to friction or pressure with the sides of the base part, tabs or flanges along the edge of the base part, hook-and-loop fasteners, or combinations thereof. The holes in the foam insert may taper downwards in diameter, and the foam insert may extend for some or all of the depth of the base part, thereby allowing the hole in the foam to securely hold the cup or container placed in the hole. The foam insert may be used without or with alignment fins or tabs, as described above.

The handle can be of any suitable size or configuration. In one embodiment, the handle is molded from ridged material, and comprises a T-shape at each end to engage the base parts and help lock the carry tray together. A contoured or cushioned grip may be located at the top center of the handle. The handle can be rotated to the side for removal or assembly. The carry tray can be used with or without the handle.

DETAILED DESCRIPTION OF EXEMPLARY EMBODIMENTS

Figure 1:
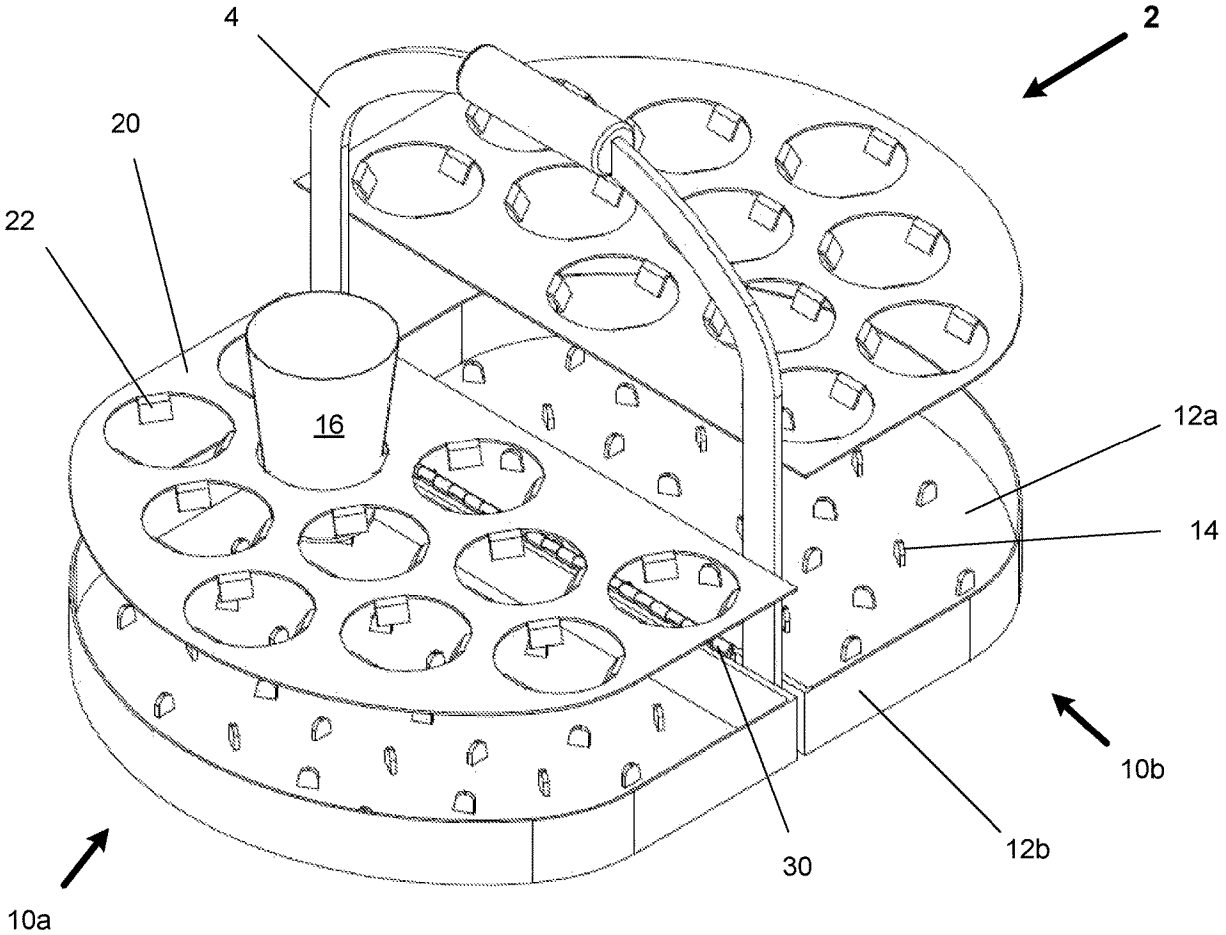
FIG. 1 shows a perspective view of a carry tray and components thereof in accordance with an exemplary embodiment of the present invention.

In various exemplary embodiments, as seen in FIGS. 1-16, the present invention comprises a carry tray 2 with a removable or detachable handle 4. The tray comprises a two-part base 10*a, b* hingedly attached 30 along adjacent edges. Each base comprises a bottom 12*a*, with a side 12*b* extending upwards along the circumference, in whole or in part Each part of the base can be polygonal, semi-circular, hemi-circular, rectilinear, curved, or combinations thereof. As seen in FIG. 1, the parts of the base can be mirror images of each other, although in other embodiments the two parts may vary. As seen in FIG. 4, the tray can be folded up along the hinge 30 into a closed position for convenient storage or transport when not in use.

Figure 2:
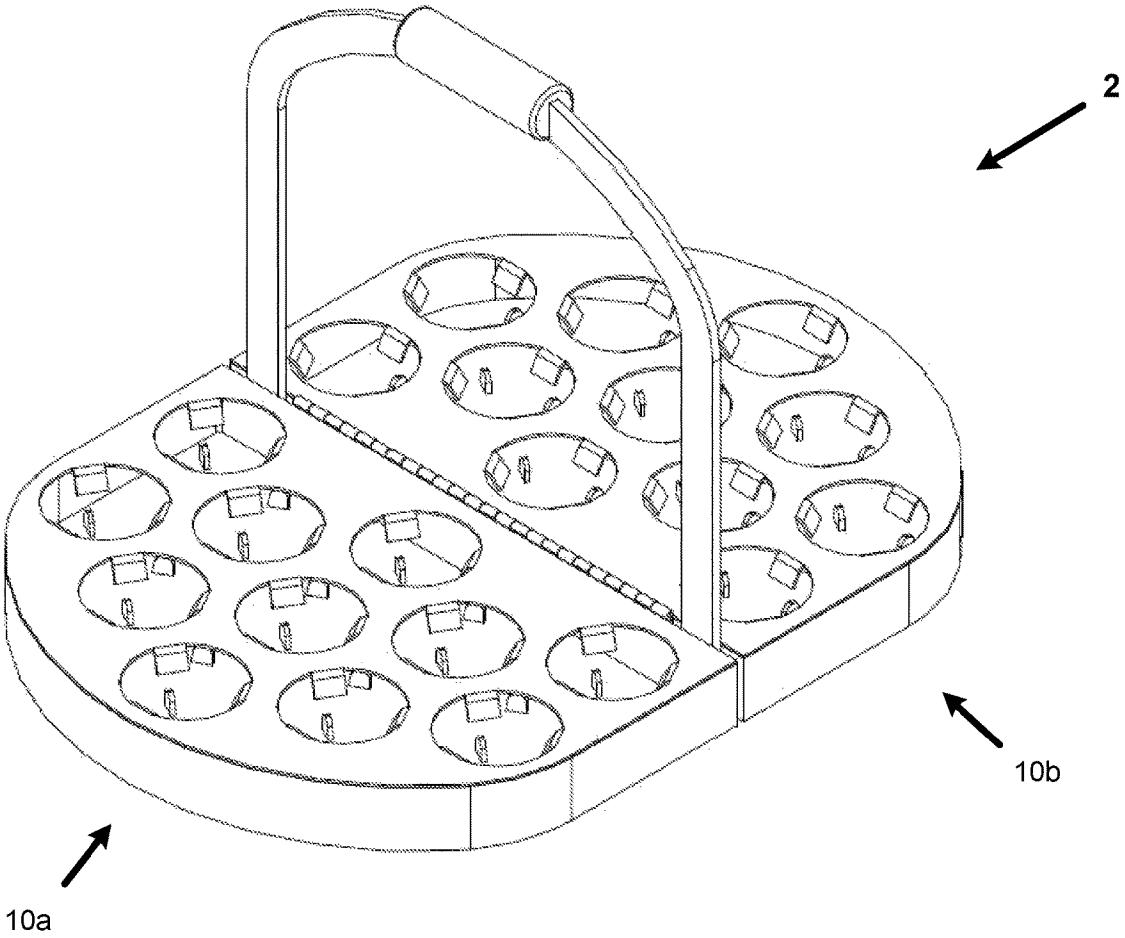
FIG. 2 is a perspective view of the carry tray of FIG. 1 with hole templates inserted.
Figure 5:
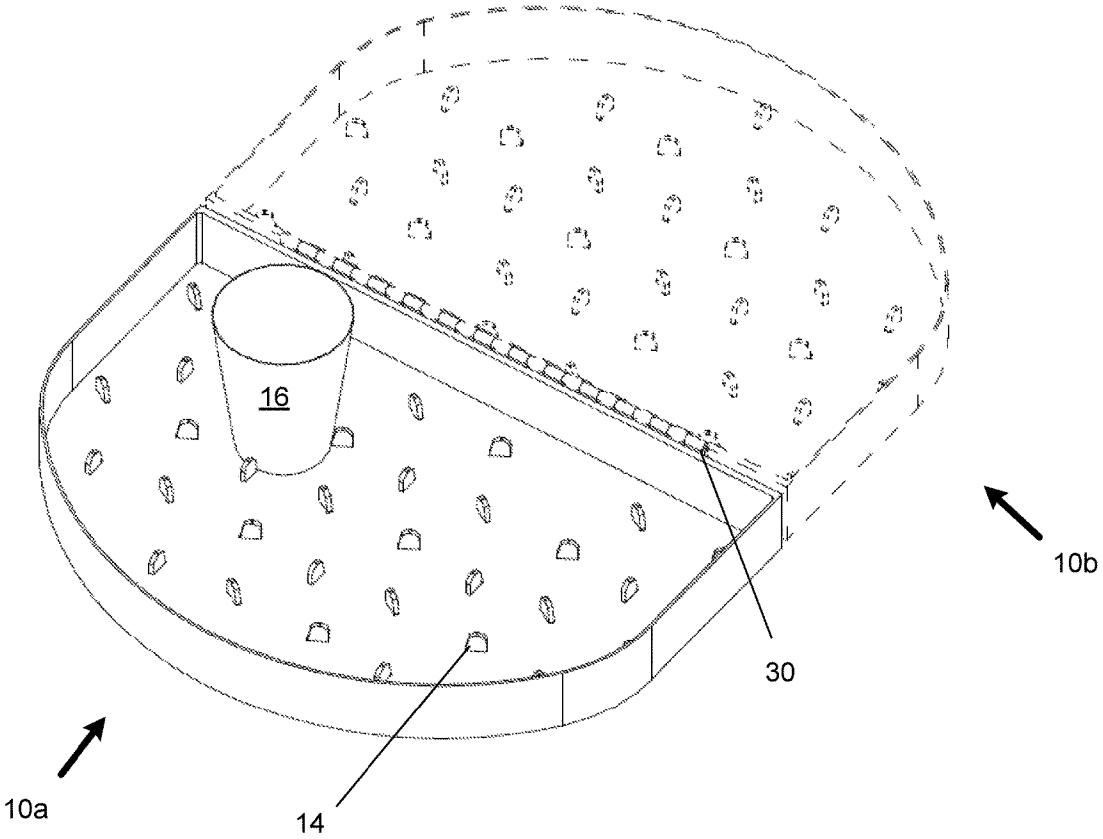
FIG. 5 is a perspective view of the base of the carry tray with alignment fins.
Figure 6:
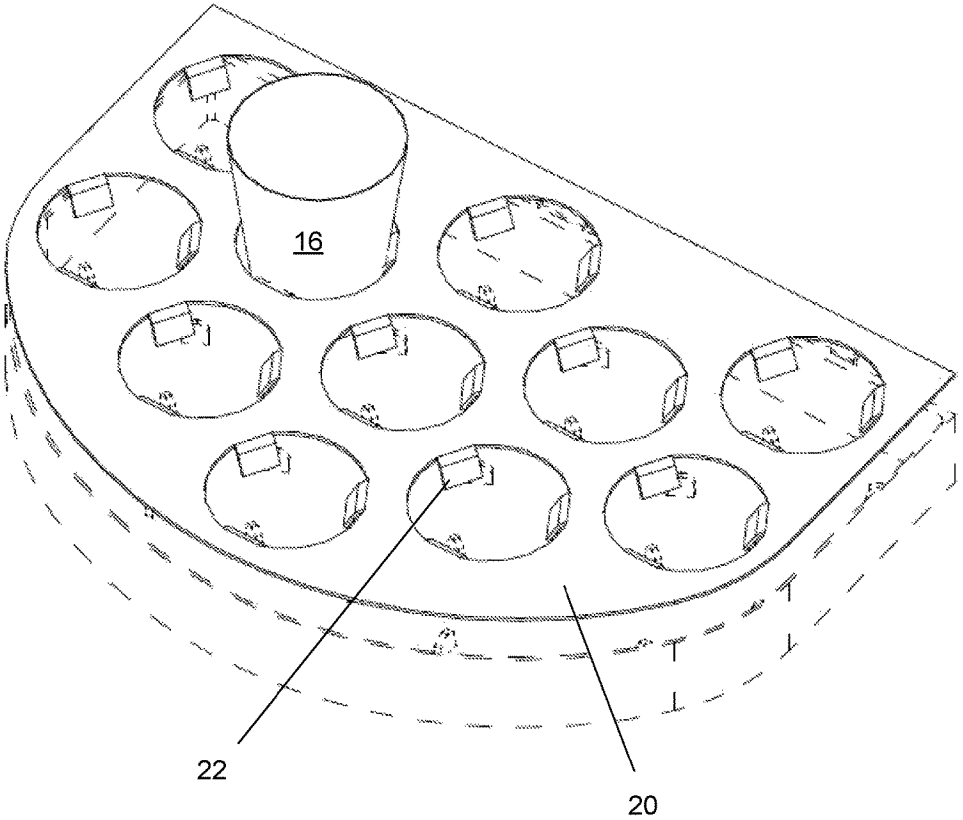
FIG. 6 is a perspective view of a hole template.
Figure 7:
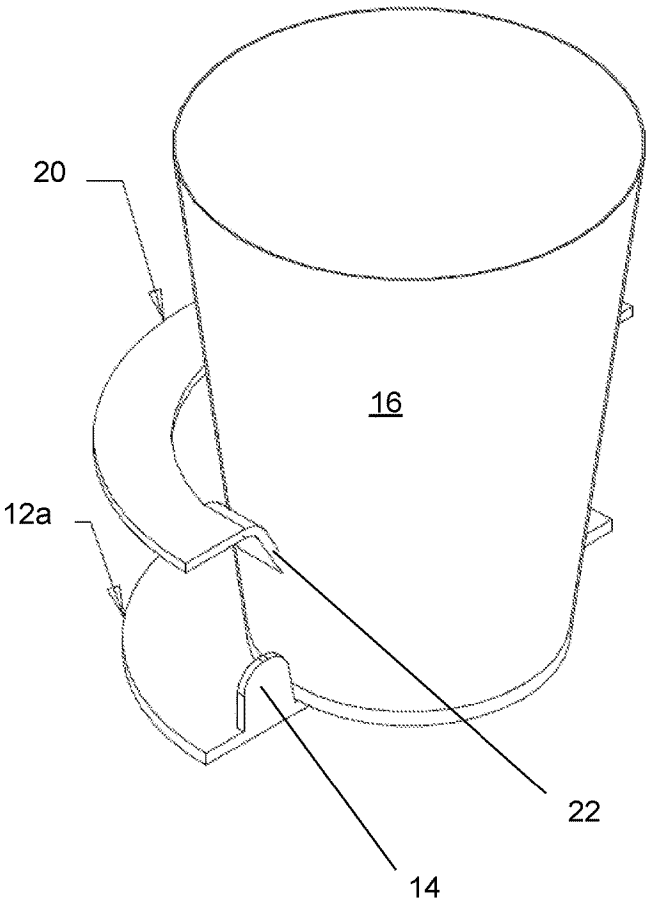
FIG. 7 is a cutaway view of a cup engaged by a hole template and alignment fins.

In one exemplary embodiment, as seen in FIGS. 1-2, one or both of the base parts comprise a plurality of alignment fins or tabs 14. The alignment fins are arranged or positioned to engage the bottom of a cup or bottle 16 and help secure or hold the cup or bottle in place. The fins may be tapered or rounded, to help receive and guide the bottom of the cup or bottle into place. While FIG. 5 shows three alignment fins engaging each cup or bottle, any number of fins can be used to engage each cup or bottle. In some embodiments, no alignment fins or tabs need be used, or alternative means to help secure the bottom of each cup or bottle may be used (such as indentations or recessed areas in the base).

One more hole templates 20 also may be used to help secure cups or bottles. Templates may be sized to match the corresponding base part, and may be removably secured thereto (i.e., snap-fit into the base part). Templates comprise one or more holes into which a cup or bottle is inserted. Holes may be positioned to align with corresponding sets of alignment fins or tabs 14. In one embodiment, flexible tabs 22 may extend at an angle inside each hole to engage the sides of the cup or bottle and help hold it upright therein.

Figure 3:
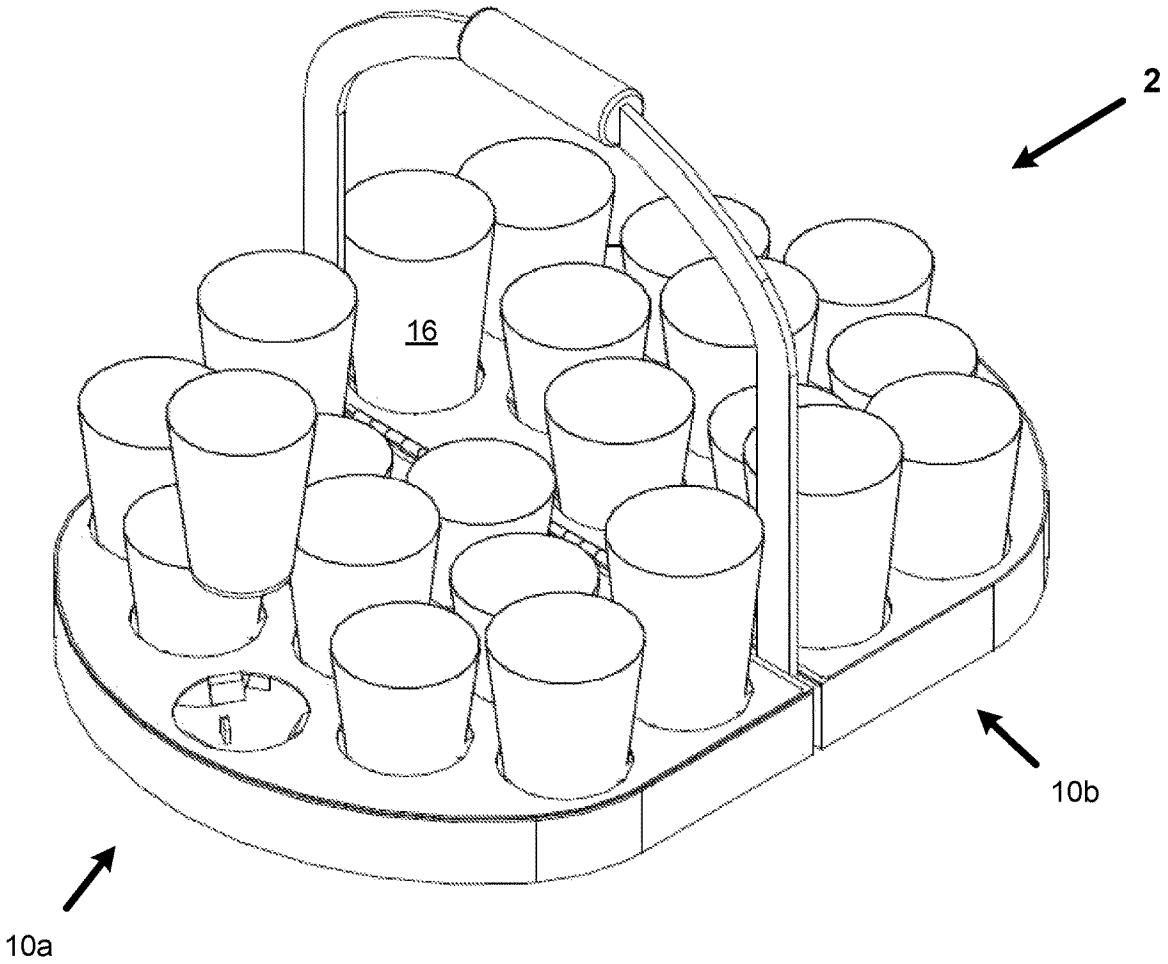
FIG. 3 is a perspective view of the carry tray of FIG. 2 with cups inserted.
Figure 4:
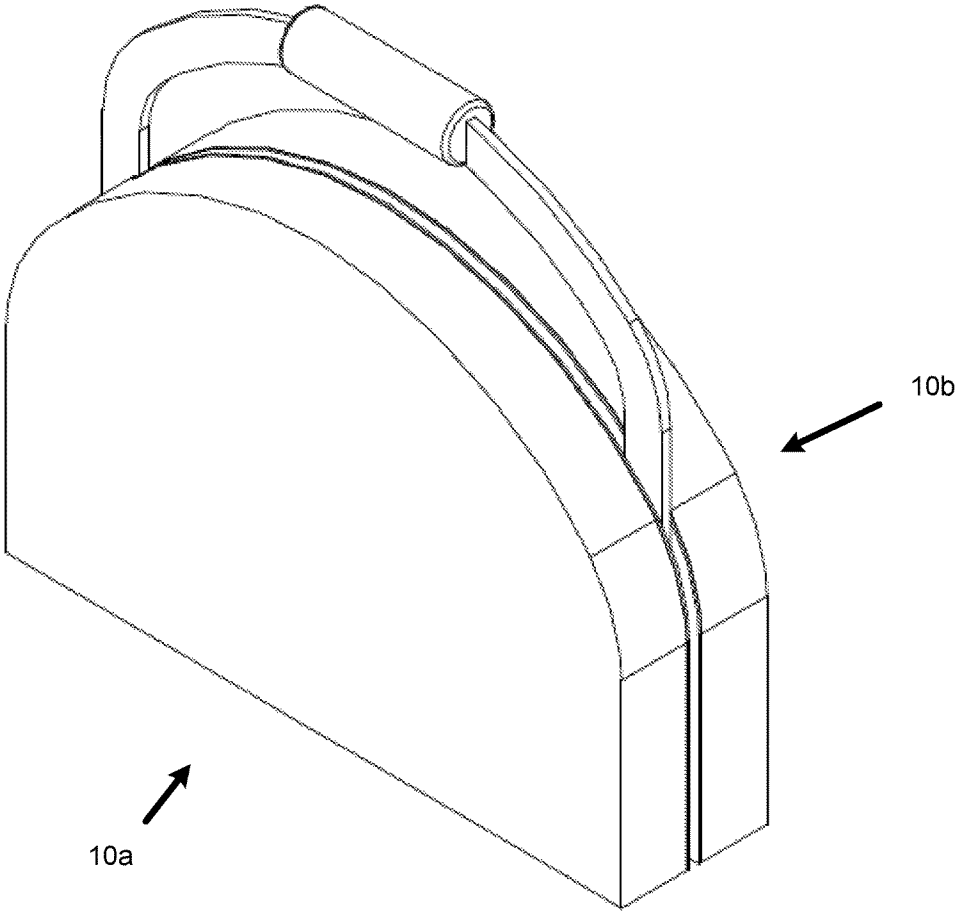
FIG. 4 is a perspective view of the carry tray of FIG. 1 in a closed position.

The carry tray can thus be used to carry drinks on both sides, as seen in FIG. 3. Alternatively, a hole template can be removed from one side, thereby allowing the carry tray to be used to carry drinks on one side, and other items (e.g., food, snacks, and the like) on the other side. Both hole templates also may be removed and carry tray used for food, snacks, and the like on both sides.

In another exemplary embodiment, as seen in FIGS. 13-16, foam inserts 40 may be used in place of hole templates (or as a form of hole template). The foam inserts 40 may be placed into corresponding base parts, and are held in place due to friction or pressure with the sides of the base part, tabs or flanges along the edge of the base part, hook-and-loop fasteners, or combinations thereof. The holes 42 in the foam insert may taper downwards in diameter, or may otherwise vary in inner diameter within a single hole. The foam insert may extend for some or all of the depth of the base part, thereby allowing the hole in the foam to securely hold the cup or container placed in the hole. The foam insert may be used without or with alignment fins or tabs, as described above.

For hole templates or foam inserts, the holes in a particular template or insert may vary in size, or some or all may have the same dimensions. In several embodiment, the uppermost edge of the hole may be beveled 44, to assist in the insertion of a cup or bottle. Thus, a given template or insert may be used to hold different sized cups or bottles. In one embodiment, a template or insert may have holes only in part of the template or insert, allowing the other portions of the insert to be used to carry food, snacks, and the like on that side. The template or foam insert may be provided with an box or indentation or other impression for this purpose. The same effect may be achieved with the template or insert only partially covering the base, or it respective part of the base.

Figure 8:
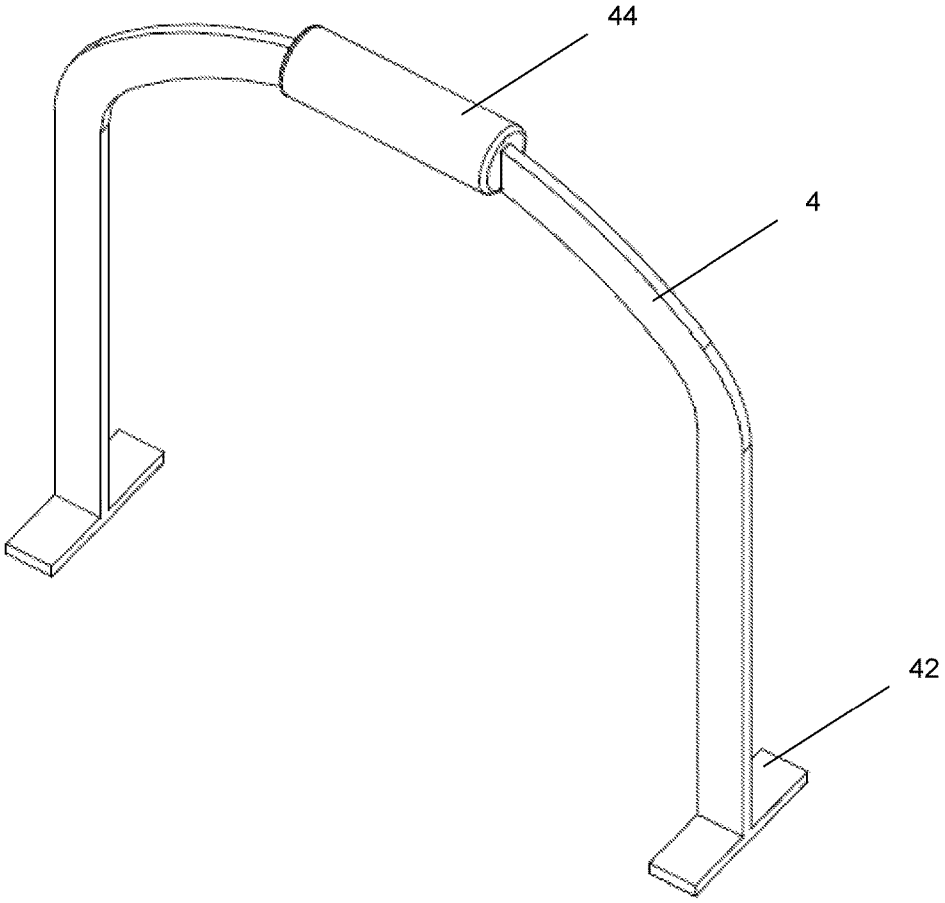
FIG. 8 is a perspective view of a handle.
Figure 9:
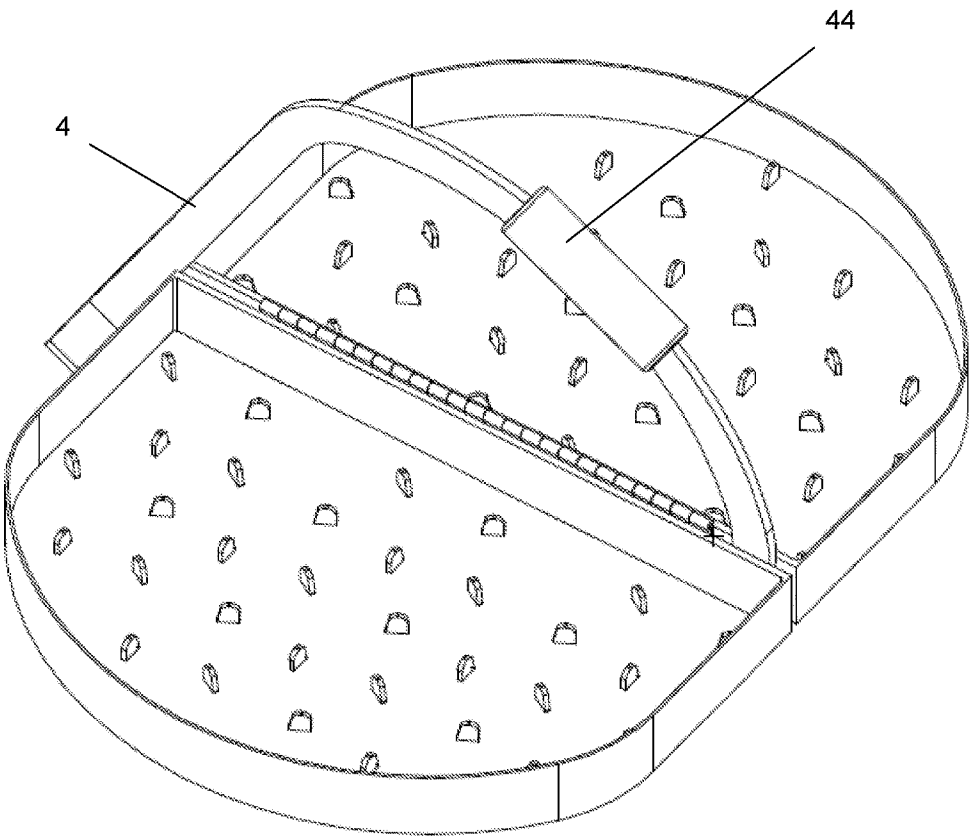
FIG. 9 is a perspective view of a carry tray with a handle in the process of removal.
Figure 10:
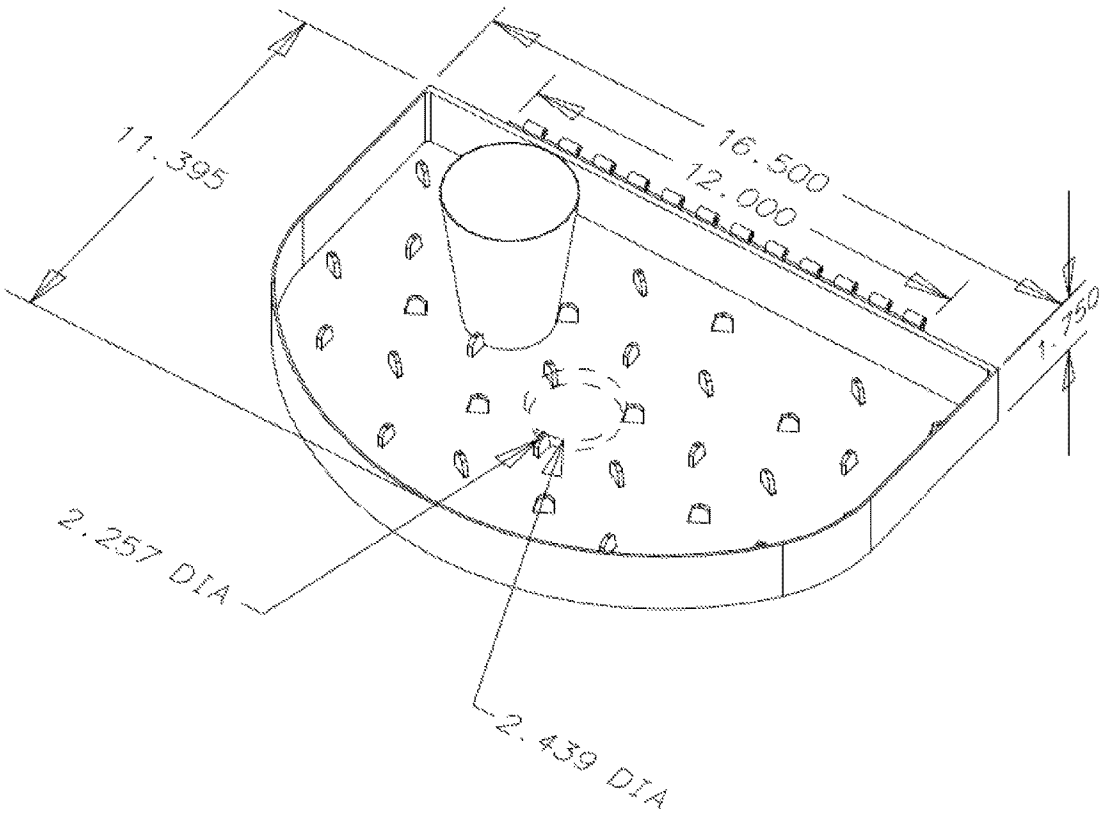
FIG. 10 is another view of the base of the carry tray with alignment fins.
Figure 11:
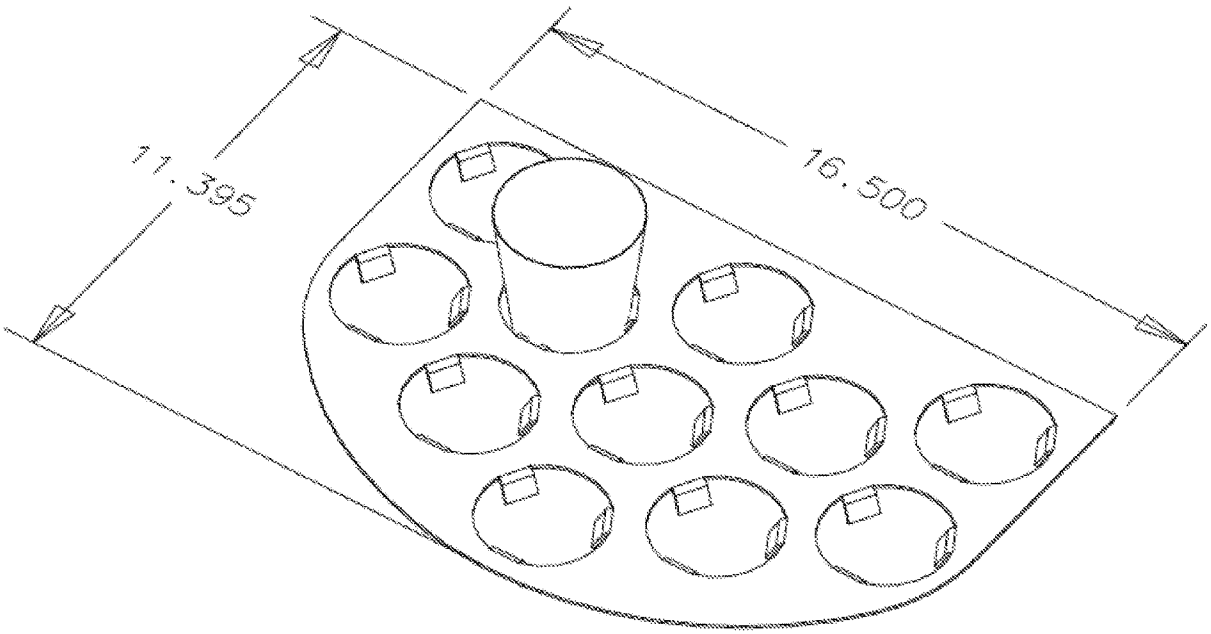
FIG. 11 is another view of a hole template.
Figure 12:
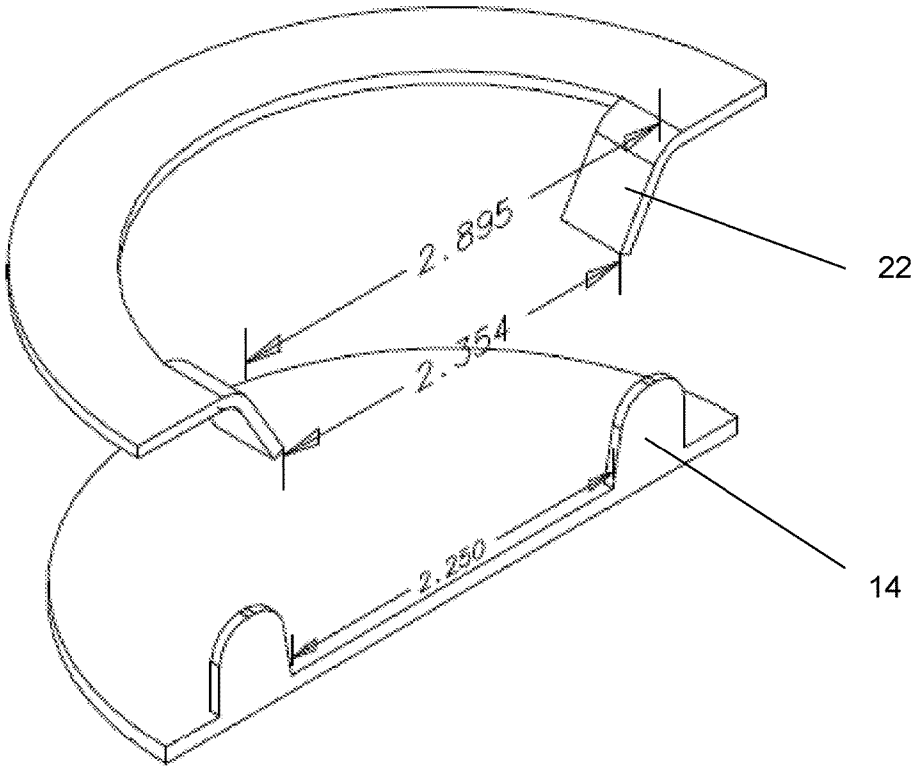
FIG. 12 is another cutaway view of the hole section of a hole template in relation to alignment fins on the base.
Figure 13:
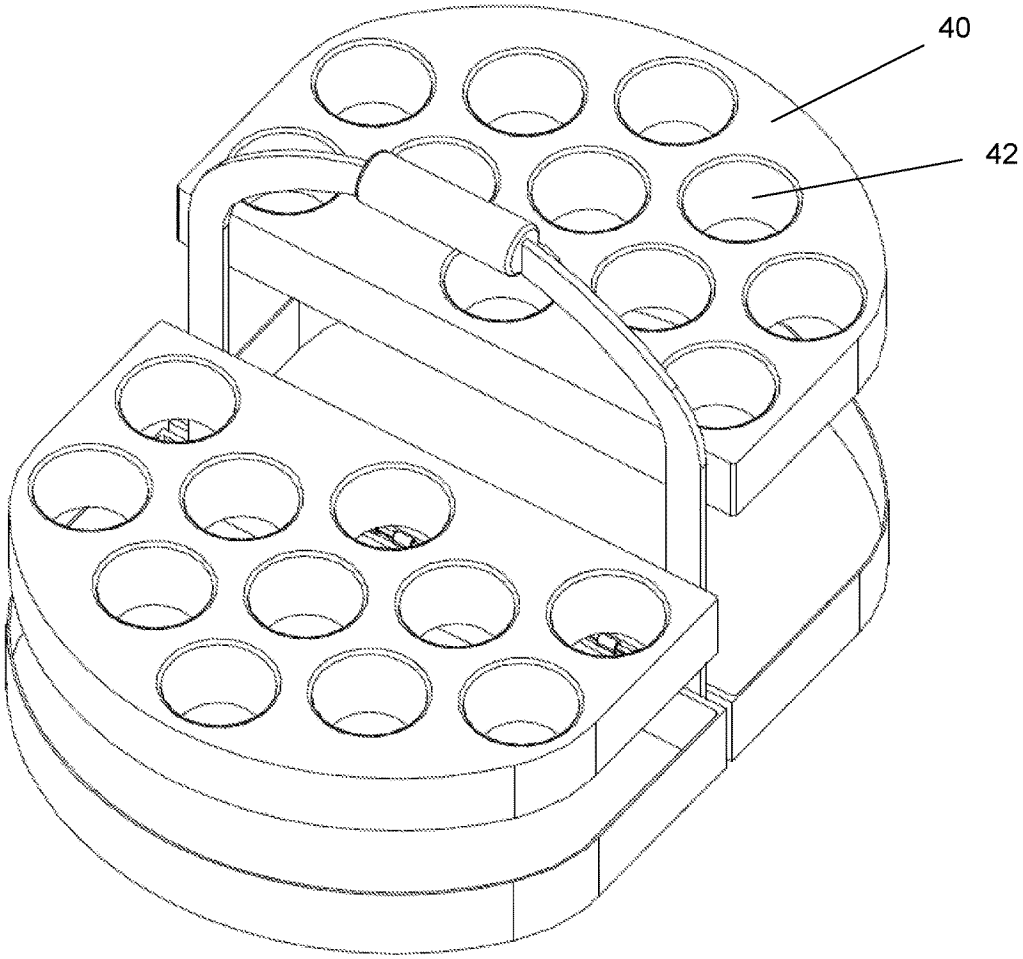
FIG. 13 is a perspective view of a carry tray with foam inserts.
Figure 14:
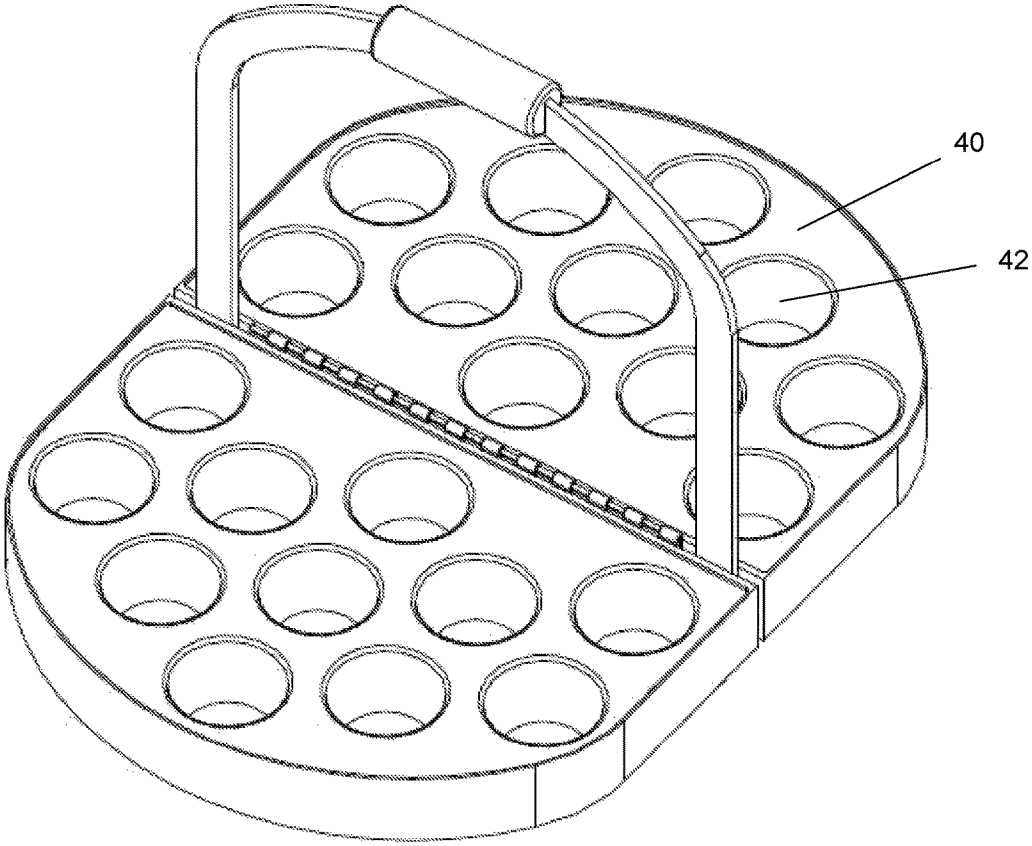
FIG. 14 is a perspective view of the carry tray of FIG. 13 with foam inserts in place.
Figure 15:
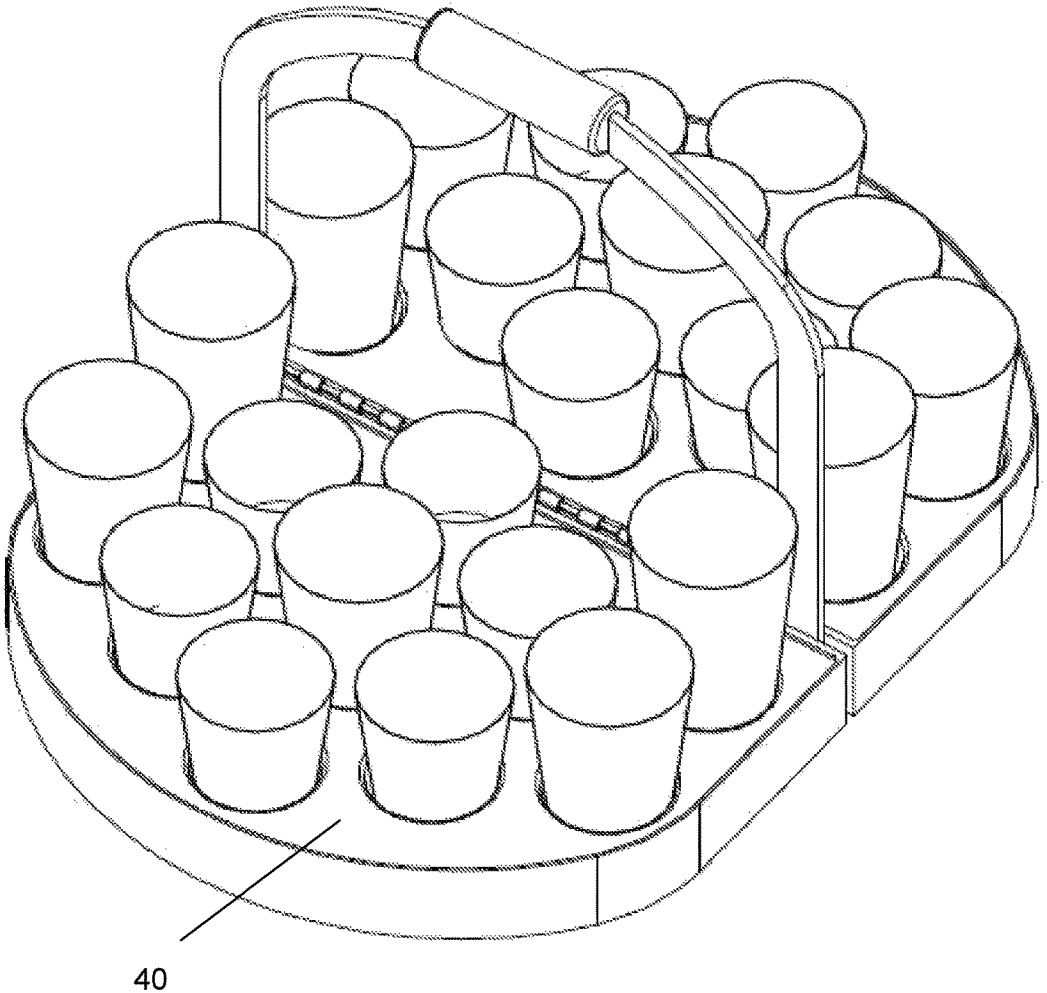
FIG. 15 is a perspective view of the carry tray of FIG. 14 with cups inserted.
Figure 16:
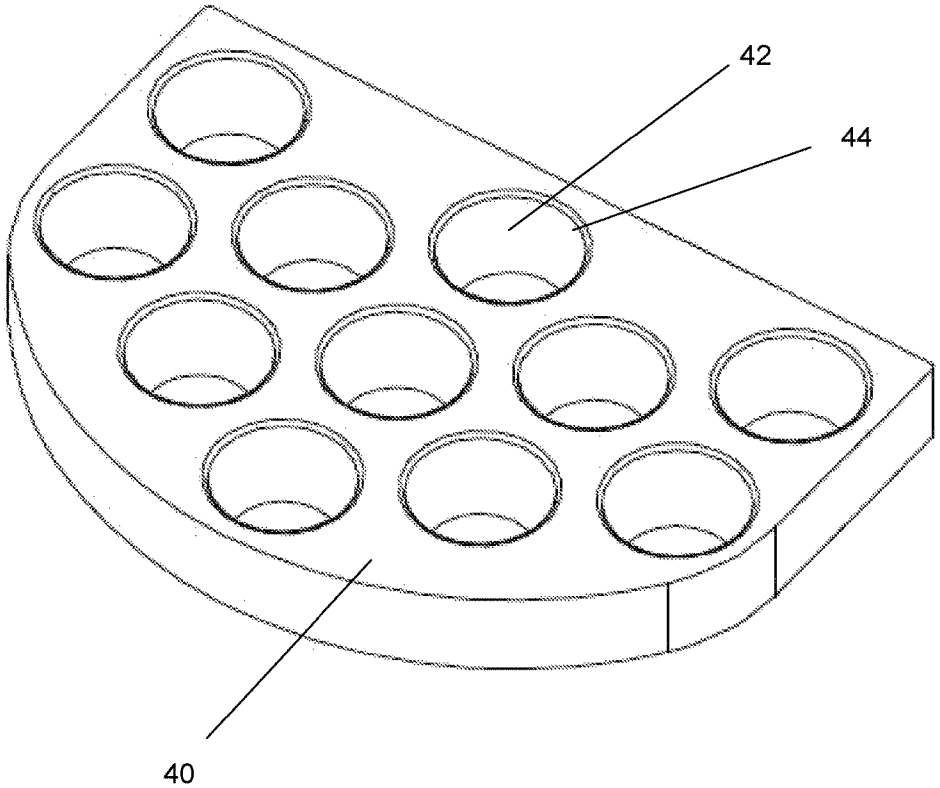
FIG. 16 is a perspective view of a foam insert.

The handle can be of any suitable size or configuration. In one embodiment, as seen in FIGS. 8-9, the handle 4 is molded from ridged material, and comprises a T-shape 42 at each end to engage the base parts and help lock the carry tray together. A contoured or cushioned grip 44 may be located at the top center of the handle. The handle can be rotated to the side for removal or assembly, as seen in FIG. 9. The carry tray can be used with or without the handle.

The dimensions of the carry tray can vary as needed to meet the needs of different venues. In one embodiment, each base part is approximately 16.5 inches long (along the hinged side), approximately 11.395 inches wide, and approximately 1.75 inches deep. The template is sized to match. Each set of alignment fins 14 is spaced to accommodate a circle of approximately 2.257 inches in diameter, while the hole tabs 22 are sized to accommodate a circle of approximately 2.354 inches in diameter at their narrowest point. These dimensions are suited to engage most standard size cups used in sporting and similar venues in the United States. In this configuration, the carry tray can carry up to 11 hot or cold beverages on either side (22 total). The central, stationary handle (when in place) allows the user to do so with one hand, thereby allowing a user to safely and efficiently carry a variety of drinks and other items from a vendor or other place of purchase to another location (e.g., seats, box, or the like) for consumption.

The carry tray can be made of any suitable material. In one embodiment, the carry tray is made of plastic, in whole or in part, and is washable and reusable.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A carry tray, comprising:

a base with a bottom and side walls extending up along the outer perimeter of the bottom, said base comprising two symmetrical halves hingedly attached along a corresponding side, with a corresponding hole template for each half;

a plurality of arrays of alignment fins on the bottom of the base, each array of alignment fins comprising three or more fins each with an inner side, wherein the fins in the array are disposed so the inner side of each fin would lie on the circumference of a circle circumscribed between the fins; and one or more hole templates supported by said side walls, each said hole template comprising a plurality of circular holes, wherein each circular hole aligns with a corresponding array of alignment fins.

2. The carry tray of claim 1, wherein the hole templates are independently removable.

3. The carry tray of claim 1, said circular holes further comprising a plurality of flexible tabs extending inward.

4. The carry tray of claim 1, each half of the base comprising eleven arrays of alignment fins.

5. A carry tray, comprising:

a base with a bottom and side walls extending up along the outer perimeter of the bottom, said base comprising two symmetrical halves hingedly attached along a corresponding side, with a corresponding foam template for each half; and one or more foam templates disposed in the base between said sidewalls, each said foam template comprising a plurality of holes.

6. The carry tray of claim 5, wherein the holes in the foam template extend entirely therethrough.

7. The carry tray of claim 5, wherein the one or more foam templates are independently removable.

8. The carry tray of claim 5, further comprising a handle.

9. The carry tray of claim 5, wherein the handle is removable.

10. The carry tray of claim 5, wherein the holes taper.

11. The carry tray of claim 5, wherein the holes have varying inner diameters within each hole.

12. The carry tray of claim 5, wherein a hole in a foam template has the same dimensions as one or more other holes in the same foam template.

13. The carry tray of claim 5, wherein a hole in a foam template has different dimensions from one or more other holes in the same foam template.

14. A carry tray, comprising:

a base with a bottom and side walls extending up along the outer perimeter of the bottom;

a plurality of arrays of alignment fins on the bottom of the base, each array of alignment fins comprising three or more fins each with an inner side, wherein the fins in the array are disposed so the inner side of each fin would lie on the circumference of a circle circumscribed between the finds;

one or more hole templates supported by said side walls, each said hole template comprising a plurality of circular holes, wherein each circular hole aligns with a corresponding array of alignment fins; and a removable handle.

* * * * *